US005729997A

United States Patent [19]

Witsoe

[11] Patent Number: 5,729,997

[45] Date of Patent: Mar. 24, 1998

[54] REFRIGERATOR AIR CIRCULATION SYSTEM

[75] Inventor: Craig Allan Witsoe, Evanston, Ill.

[73] Assignee: General Electric Company, Louisville, Ky.

[21] Appl. No.: 613,435

[22] Filed: Feb. 29, 1996

[51] Int. Cl.[6] ..... F25D 17/04

[52] U.S. Cl. ..... 62/407; 62/441; 62/426; 62/452

[58] Field of Search ..... 62/404, 407, 440, 62/441, 426, 427, 452

[56] References Cited

U.S. PATENT DOCUMENTS

| | | | |
|---|---|---|---|
| 2,285,946 | 6/1942 | Kalischer | 62/6 |
| 2,416,354 | 2/1947 | Shoemaker | 62/6 |
| 3,090,209 | 5/1963 | Hubacker | 62/441 |
| 3,359,751 | 12/1967 | Stevens | 62/441 |
| 4,326,390 | 4/1982 | Brooks | 62/441 |

*Primary Examiner*—John M. Sollecito
*Attorney, Agent, or Firm*—H. Neil Houser

[57] ABSTRACT

A refrigerator includes a freezer, a fresh food compartment and an evaporator chamber. A supply conduit conducts cold air from the evaporator chamber to the top rear of the fresh food compartment and a return conduit conducts warm air from the fresh food compartment to the evaporator chamber. A fan mounted adjacent the bottom rear portion of the fresh food compartment directs air up the rear wall of the fresh food compartment to enhance air circulation in the fresh food compartment and reduce moisture condensation therein.

9 Claims, 2 Drawing Sheets

REFRIGERATOR AIR CIRCULATION SYSTEM

BACKGROUND OF THE INVENTION

Many present day refrigerators have separate freezers and fresh food compartments with separate access doors. They may be "top mount" models, in which the freezer is positioned above the fresh food compartment, or "side-by-side models, in which the freezer and fresh food compartments are positioned in a side-by-side configuration. In either case it is common to position the evaporator in a chamber formed at the rear of the freezer compartment and separated from the freezer compartment by a dividing wall. The evaporator provides air which is chilled to a below freezing temperature. A fan in the evaporator chamber blows part of the chilled air into the freezer compartment to maintain it below freezing and part of the chilled air into the fresh food compartment to maintain it in the desired, above freezing temperature range. Typically, whether the refrigerator is of the top mount or the side-by-side type, a supply conduit conducts relatively cold air from the evaporator chamber and discharges it into the upper rear portion of the fresh food compartment. A return conduit conducts relatively warm air from the fresh food compartment to the evaporator chamber, where the fan draws it across to evaporator to again chill it to a below freezing temperature.

In many homes the door of the fresh food compartment is opened fairly often, admitting moist warm air. In addition, many foods stored in the fresh food compartment are moist and are not tightly sealed. Thus the atmosphere or air in the fresh food compartment is fairly moist. The chilled air entering the fresh food compartment tends to fall toward the bottom of that compartment. As a result, the top portions of these walls and support shelves near the top of the compartment are cooled to a point below the dew point of the air in the compartment. When the ambient air has a high moisture content, beads of moisture condense on these walls and support shelves. This condensation is unsightly and can drip onto food items and cause premature spoilage.

It is an object of the present invention to provide a refrigerator having an improved air circulation system.

It is another object of this invention to provide a refrigerator in which the air flow in the fresh food compartment is enhanced.

SUMMARY OF THE INVENTION

In accordance with one form of the invention a refrigerator includes a fresh food compartment and an evaporator separate from the fresh food compartment to chill air for maintaining the fresh food compartment in a predetermined temperature range. A supply conduit delivers to the upper portion of the fresh food compartment air which has been chilled by the evaporator and a return conduit conducts relatively warm air from the fresh food compartment to the evaporator for rechilling. A fan mounted in the lower rear portion of the fresh food compartment enhances circulation of air in the fresh food compartment. This mixes the air in the compartment with cold, dry air entering the compartment so that moisture condensation is minimized and the moisture is more effectively transferred to the evaporator.

BRIEF DESCRIPTION OF THE DRAWINGS

The subject matter regarded as the invention is particularly pointed out and distinctly claimed in the concluding portion of the specification. The invention, however, both as to organization and method of operation, together with further objects and advantages thereof, may be better understood by reference to the following description when read with the accompanying drawings in which:

DETAILED DESCRIPTION OF PREFERRED EMBODIMENT

Figure 1:
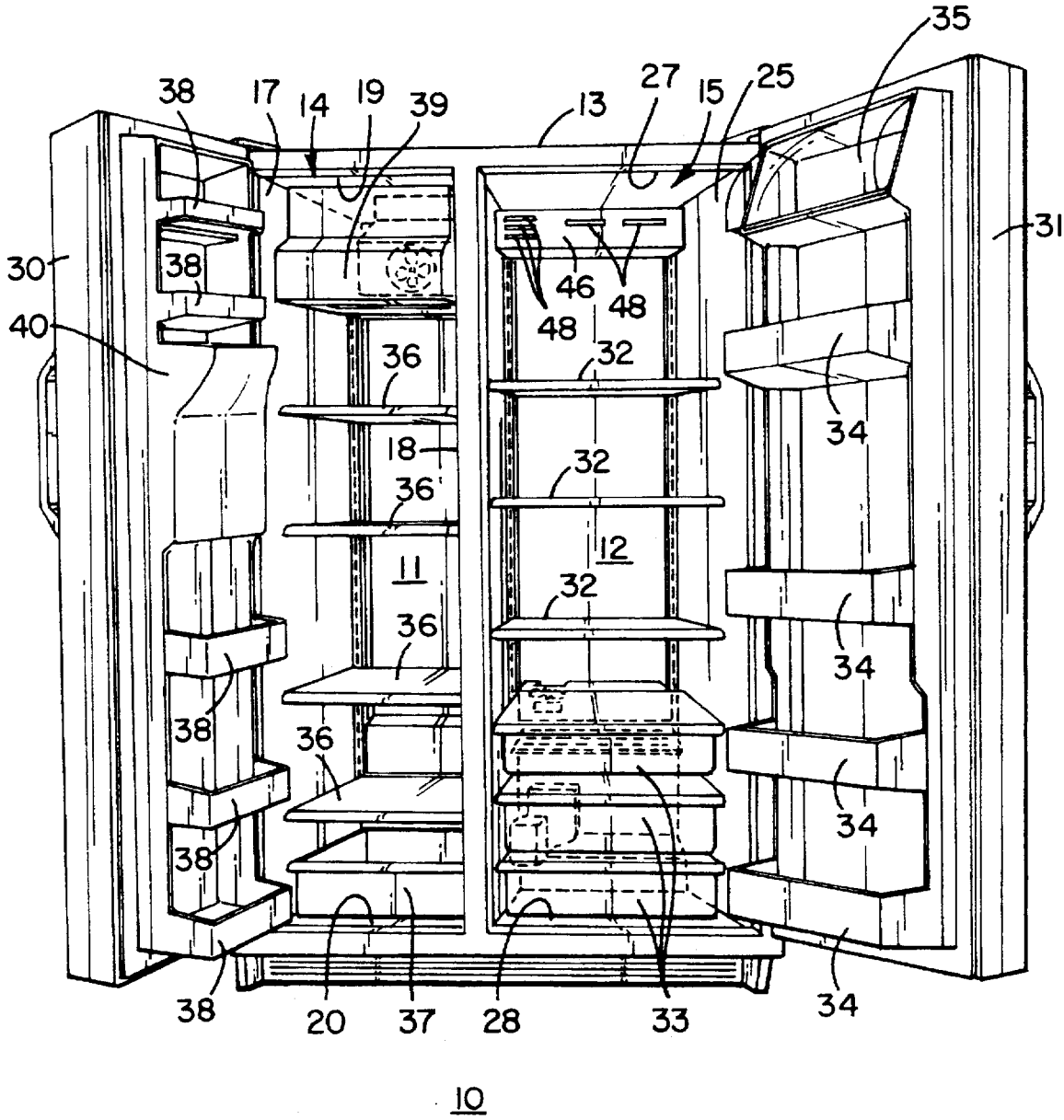
FIG. 1 is a simplified front perspective view of a side-by-side refrigerator incorporating one embodiment of the present invention, with the access doors open for illustrative purposes.
Figure 3:
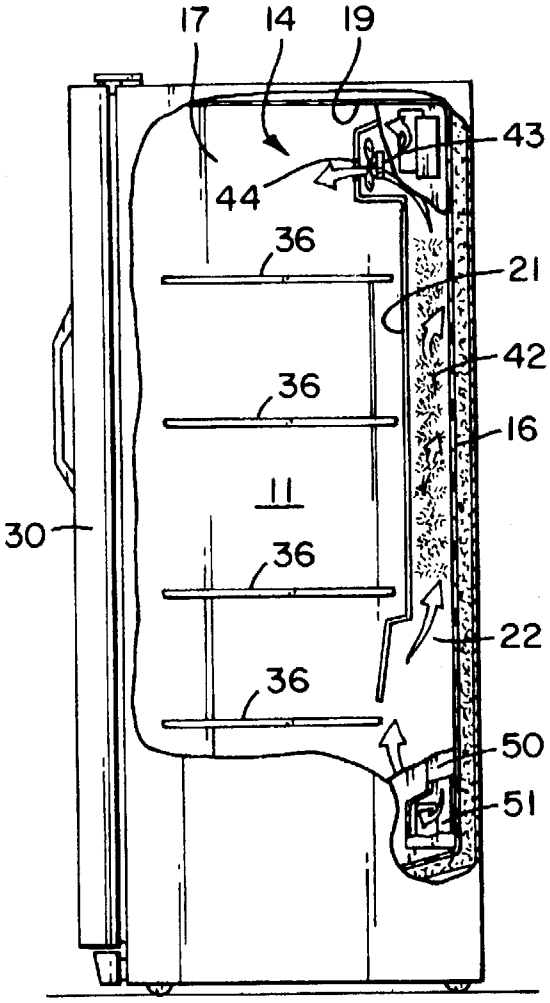
FIG. 3 is a simplified side elevation of the refrigerator of FIG. 1, partly broken away to illustrate air flow through the evaporator chamber.
Figure 2:
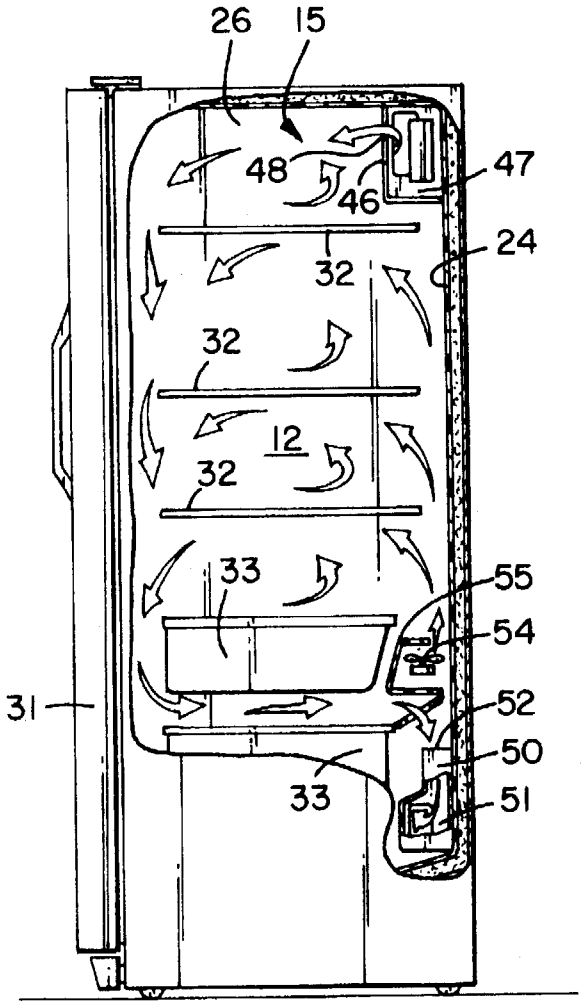
FIG. 2 is a simplified side elevation view of the refrigerator of FIG. 1, partly broken away to illustrate air flow in the fresh food compartment.

FIG. 1 illustrates a household refrigerator 10 of the side-by-side type with a freezer storage compartment 11 and a fresh food storage compartment 12 arranged side-by-side within the refrigerator. The refrigerator 10 has an outer case or cabinet 13 and a pair of liners 14, 15 separated by insulation. Referring to FIGS. 1 and 3, the liner 14 includes a rear wall 16, side walls 17, 18 a top wall 19 and a bottom wall 20 which define the freezer compartment 11. A vertical partition or dividing wall 21 is spaced in front of the rear wall 16 and defines an evaporator chamber 22 at the rear of but separate from the freezer compartment 11. Referring to FIGS. 1 and 2, the liner 15 includes a rear wall 24, side walls 25, 26, a top wall 27 and a bottom wall 28 which define the fresh food compartment 12. The front of compartments 11, 12 are open and selectively are closed by doors 30, 31 respectively.

Shelves 32 and drawers 33 normally are provided in the fresh food compartment to support items being stored therein. In less fully featured models the shelves may be made of wire while, in more fully featured models, the shelves may be of tempered glass or high impact plastic. Also bins 34 and a closed temperature controlled butter or cheese keeper 35 are provided on fresh food door 31 for additional storage. Similarly, shelves 36 and a bin 37 are normally provided in freezer 11 and bins 38 are provided in freezer door 30. The illustrative freezer 11 includes an automatic ice maker 39 and a dispenser 40 is provided in the door 30 so that ice can be obtained without opening door 30.

Referring now to FIGS. 1, 2 and 3, the evaporator chamber extends along substantially the entire height of freezer rear wall 16. A vertically elongated evaporator 42 is mounted in the chamber 22 and an electrically operated fan 43 is mounted in the upper portion of chamber 22. When energized, the fan draws air into the lower portion of the chamber 22 from both the freezer 11 and fresh food compartment 12. The air flows over the evaporator 42 which chills it to a temperature well below freezing. The fan 43 discharges relatively cold air to the freezer and fresh food compartments. To this end an opening 44 is formed toward the upper end of panel 21 for air flow from chamber 22 to freezer 11. An opening, not shown, is formed toward the lower end of panel 22 for relatively warmer air to flow from the freezer compartment 11 to the chamber 22 below the evaporator 42.

A housing 46 extends across the top rear portion of fresh food compartment 12. The housing 46 and the corresponding upper rear portion of liner 15 form a supply conduit 47 which communicates with evaporator chamber 22 and delivers relatively cold air from the evaporator chamber to the fresh food compartment. In the illustrative refrigerator the housing 46 has openings 48 through which the chilled air enters the fresh food compartment. This chilled air initially flows generally horizontally along top wall 27. A housing 50 is provided at the lower rear portion of the fresh food compartment 12 and, together with rear wall 24, forms a return conduit communicating with the lower portion of evaporator chamber 22. Relatively warm air from fresh food compartment 12 flows through the open top 52 of housing 50 and returns to the lower portion of evaporator chamber 22.

The chilled air entering the top of fresh food compartment 12 tends to flow downward along the rear and side walls 24–6. Thus it tends to cause the upper portion of these walls, as well as the top wall 27 and the upper shelf 32, to have temperatures below the dew point of the ambient air in the fresh food compartment. When this ambient air has a relatively high humidity, undesirable moisture condensation will collect on these very cold surfaces.

In accordance with the illustrative embodiment of this invention, an air circulator 54 is mounted to the lower portion of rear wall 24 and directs a stream of air upward along rear wall 24. Conveniently an air perforate shield 55 is mounted to wall 24 and encloses circulator 54. In the illustrative embodiment the shield 55 is a plastic material with appropriate entry openings, not shown. The shield 55 also encloses a light for the fresh food compartment and the upper edge of the shield is spaced forward of wall 24 for egress of air and light. In the illustrative embodiment the circulator 54 is a low voltage DC electric fan, with the associated power conversion equipment, not shown, mounted outside the fresh food compartment. This minimizes the amount of heat introduced into the fresh food compartment by the fan.

The fan significantly increases the air flow in the fresh food storage compartment, as illustrated by the arrows in FIG. 2, which provides a improved temperature distribution in the fresh food compartment. The enhanced air circulation also increases the mixing of the ambient air in the fresh food compartment so that more of the moisture in the fresh food compartment is transferred to the evaporator. It will be deposited on the evaporator as frost and removed from the refrigerator at the next defrost cycle. In the illustrative embodiment, the fan 54 is connected to run when the evaporator fan 43 runs. However other control approaches can be adopted. For example, the fan 54 can be operated by a humidistat positioned to respond to the humidity in the fresh food compartment.

The use of a low voltage fan 54 enables the fan to be installed as an after market feature where needed, so that such fans do not have to be installed in all refrigerators of a particular model when only units in particular locations or units belonging to people who very frequently open the door need the fan.

While a specific embodiment of the invention has been illustrated and described herein, it is realized that modifications and changes will occur to those skilled in the art to which the invention pertains. By way of example only, the invention is usefull in top mount refrigerators and in refrigerators with other basic air flow patterns. It is therefore to be understood that the appended claims are intended to cover all such modifications and changes as fall within the true spirit and scope of the invention.

What is claimed is:

1. A refrigerator comprising:

a fresh food compartment;

an evaporator separate from said fresh food compartment and adapted to chill air for maintaining said fresh food compartment in predetermined temperature range;

first conduit means for delivering to said fresh food compartment air chilled by said evaporator and second conduit means for returning air from said fresh food compartment to said evaporator; and air circulation means mounted in said fresh food compartment for enhancing circulation of air therein, said air circulation means oriented to direct air generally upward within said fresh food compartment.

2. A refrigerator as set forth in claim 1, wherein:

said fresh food compartment has a vertically extending rear wall; said first conduit means delivers a flow of chilled air to said fresh food compartment adjacent the upper portion of said rear wall; and said air circulation means is mounted adjacent the lower portion of said rear wall and directs air generally upward adjacent said rear wall.

3. A refrigerator as set forth in claim 2, further including: an air pervious shield mounted about said air circulation means.

4. A refrigerator as set forth in claim 1, wherein: said air circulation means includes a fan operated by a low voltage electric motor.

5. A refrigerator comprising:

a freezer compartment and a fresh food compartment separated by an insulated partition;

an evaporator chamber separate from said freezer and fresh food compartments and positioned to the rear of said freezer compartment;

a first conduit connecting said evaporator chamber to said fresh food compartment for conducting relatively cold air from said evaporator chamber to said fresh food compartment and a second conduit, remote from said first conduit, connecting said evaporator chamber to said fresh food compartment for conducting relatively warm air from said fresh food compartment to said evaporator chamber; and air circulation means mounted in said fresh food compartment for enhancing circulation of air within said fresh food compartment, said air circulation means oriented to direct air generally upward with said fresh food compartment.

6. A refrigerator as set forth in claim 5, wherein:

said fresh food compartment has a vertically extending rear wall;

said first conduit means delivers relatively cold air to said fresh food compartment adjacent the upper portion of said rear wall; and said air circulation means is mounted adjacent the lower portion of said rear wall and directs air generally upward adjacent said rear wall.

7. A refrigerator as set forth in claim 6, further including: an air pervious shield mounted about said air circulation means.

8. A refrigerator as set forth in claim 5, wherein: said air circulation means includes a fan operated by a low voltage electric motor.

9. A refrigerator as set forth in claim 5, wherein:

said freezer and fresh food compartments are arranged in a side-by-side configuration and said evaporator chamber extends vertically along the rear of said freezer compartment;

said first conduit conducts relatively cold air to the upper end of said fresh food compartment and said second conduit conducts relatively warm air from the lower end of said fresh food compartment;

said air circulation means is positioned in the rear portion of said fresh food compartment and directs air upwardly within said fresh food compartment.

* * * * *